United States Patent [19]

Jing

[11] 4,414,821

[45] Nov. 15, 1983

[54] ICE RINK REFRIGERANT DISTRIBUTION MEANS

[76] Inventor: Li G. Jing, Block C8-31/F, Causeway Centre, Hong Kong

[21] Appl. No.: 395,855

[22] Filed: Jul. 6, 1982

[51] Int. Cl.[3] ..... A63C 19/10

[52] U.S. Cl. ..... 62/235; 62/513

[58] Field of Search ..... 62/113, 235, 513

[56] References Cited

U.S. PATENT DOCUMENTS

| | | | |
|---|---|---|---|
| 2,385,667 | 9/1945 | Webber | 62/513 |
| 2,521,040 | 9/1950 | Casetta | 62/513 |
| 3,485,057 | 12/1969 | Etter et al. | 62/235 |
| 3,910,059 | 10/1975 | MacCracken | 62/235 |

*Primary Examiner*—Ronald C. Capossela

*Attorney, Agent, or Firm*—Salter & Michaelson

[57] ABSTRACT

Ice rink refrigeration apparatus includes a liquid refrigerant supply pipe; rink pipes which receive this refrigerant and extend beneath the ice rink to effect cooling and a collection pipe which collects the vaporized or partially vaporized refrigerant from the rink pipes. The supply pipe is mounted coaxially within the collection pipe to form a common header which is positioned centrally of the rink. A unified connector piece serves to connect the two ends of each rink pipe with the supply and collector pipes respectively.

17 Claims, 5 Drawing Figures

ICE RINK REFRIGERANT DISTRIBUTION MEANS

BACKGROUND OF THE INVENTION

This invention relates to the refrigeration of ice rinks and more particularly to means for distributing refrigerant. Liquid refrigerant is supplied to a plurality of rink pipes arranged beneath the ice rink where vaporization of the refrigerant serves to effect cooling. Typically, the pipes supplying liquid refrigerant to the rink pipes and collecting gaseous refrigerant are installed in tunnels beside the rink area. Good thermal insulation is therefore essential for economic operation and great care must be taken in the provision of flexible joints and the like to allow for differential thermal expansion and contraction. The arrangements previously proposed are generally complicated to install and involve relatively high capital costs.

SUMMARY OF THE INVENTION

It is an object of this invention to provide improved refrigerant distribution means which can be installed more easily and at lower cost and which can offer more efficient and reliable operation.

Accordingly, the present invention consists in refrigerant distribution means for ice rink refrigeration apparatus, comprising a supply pipe for the supply of liquid refrigerant; a plurality of rink pipes connected with the supply pipe to receive liquid refrigerant therefrom and positioned beneath the ice rink to effect cooling by refrigerant vaporization; and a collection pipe connected with the rink pipes to collect vaporized or partially vaporized refrigerant, characterised in that the supply and collection pipes are arranged one extending longitudinally within the other to form a common header for the rink pipes.

Advantageously, the common header is positioned beneath the rink pipes and, preferably, substantially centrally of the ice rink. In one form of the invention, there are provided respective T-shaped means for the supply and return connections of each rink pipe with the common header.

With this invention, the common header can simply be buried beneath the ice rink. The total amount of pipework required, as compared with conventional systems, is considerably reduced and because the bulk of this pipework is positioned close to the ice rink in comparatively low temperature regions, the problem of heat gain is less severe. Thermal insulation to a lower standard will accordingly be acceptable. Again, because the bulk of the pipework is situated in low temperture regions, there is considerably less need for flexible pipework joints allowing for thermal expansion and contraction.

DETAILED DESCRIPTION OF AN EMBODIMENT OF THE INVENTION

Figure 5:
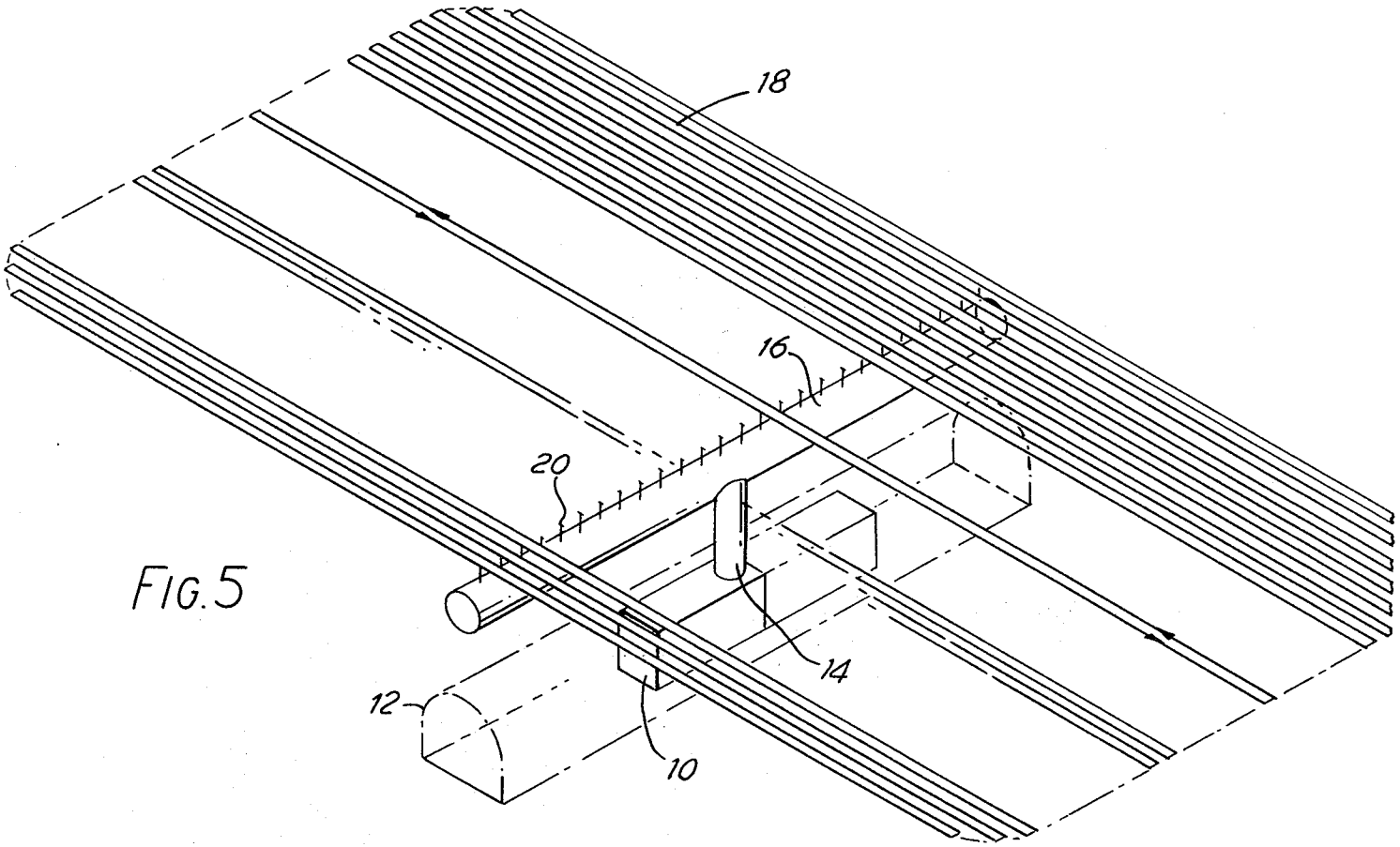
FIG. 5 is a perspective sketch of the refrigeration apparatus illustrated in the preceding figures.

Referring initially to FIG. 5, a direct expansion ice rink refrigeration system is shown in somewhat diagrammatic form. Refrigeration plant 10 is installed in a tunnel 12 beneath the ice rink and is connected through a riser 14 with a common header 16. This common header is buried a relatively short distance beneath the ice layer and extends across the breadth of the generally rectangular ice rink. A number of rink pipes 18 are connected to the common header 16 through respective connecting elements 20 which are equally spaced along the length of the header. The rink pipes 18 take the form of closed loops with an overall length equal to that of the ice rink and each connecting element is designed—as will be described—to ensure that liquid refrigerant is directed from the common header to the rink pipe in such a manner as to travel in a path around the rink pipe loop, undergoing partial or complete vaporisation as heat is absorbed from the ice rink. Vaporized refrigerant from the rink pipe is collected by the common header and recycled to the refrigeration plant.

The refrigerant distribution means according to this invention will now be described in more detail with reference to FIGS. 1 to 4.

Figure 1:
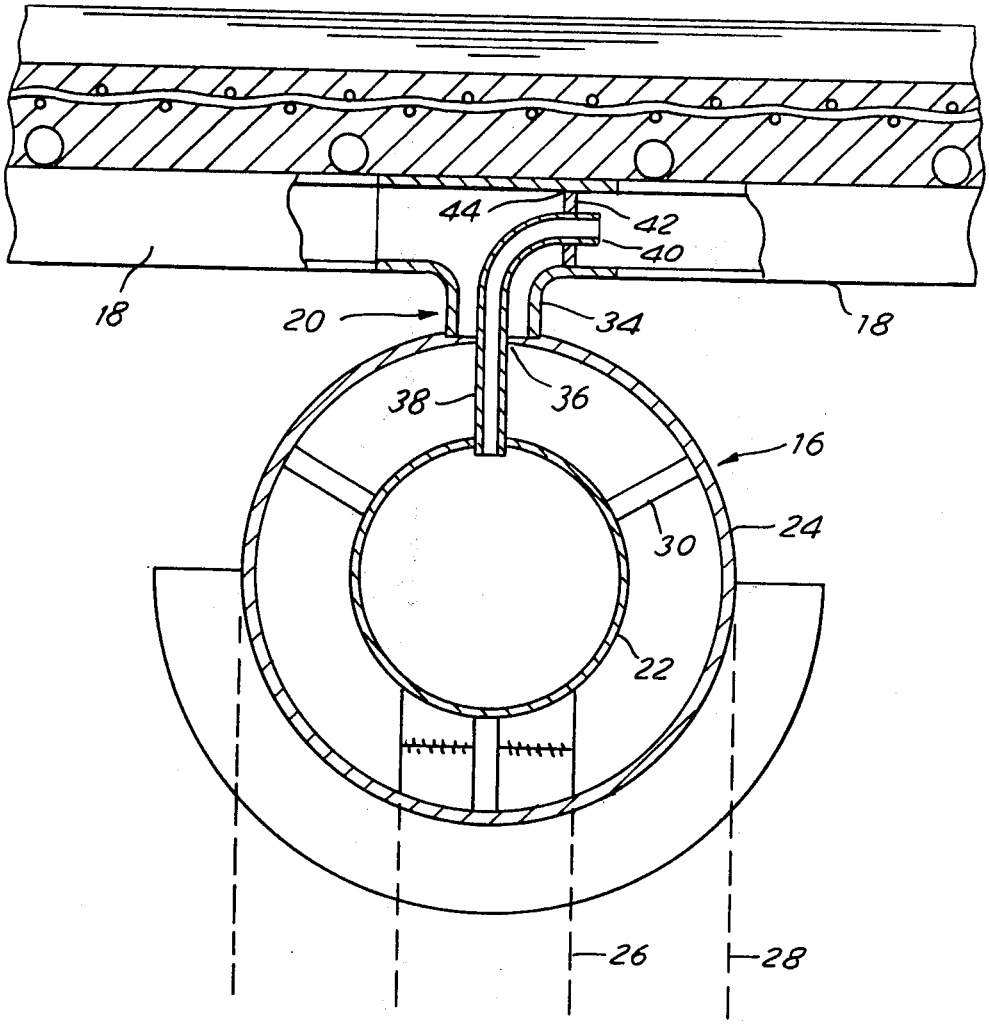
FIG. 1 is a vertical cross section through an ice rink showing refrigerant distribution means according to the present invention.
Figure 2:
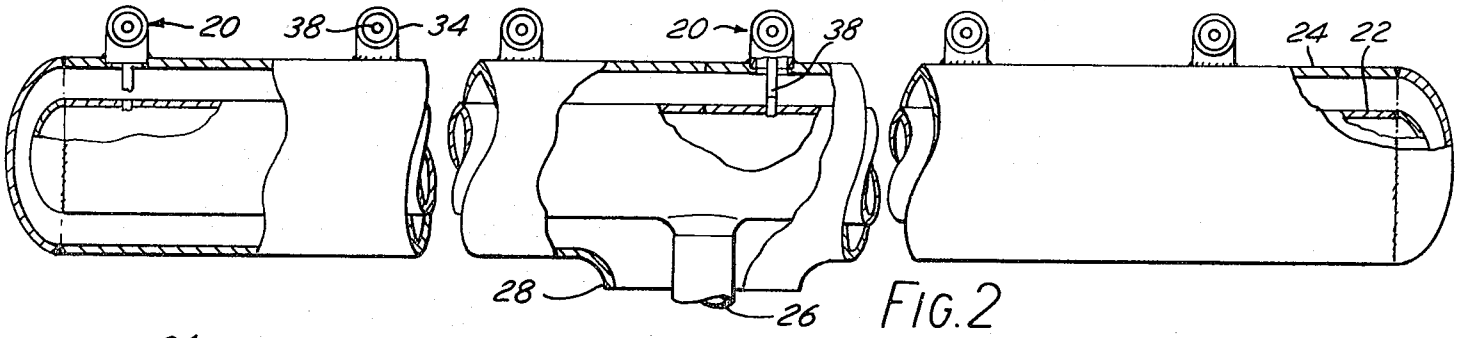
FIG. 2 is a side view—partly in section—of the refrigerant distribution means of FIG. 1, other ice rink components having been omitted for the sake of clarity.
Figure 4:
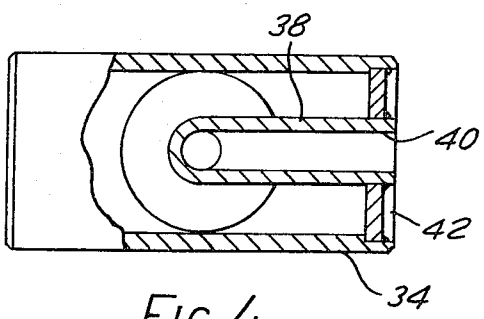
FIG. 4 is a plan view of the part shown in FIG. 3.
Figure 3:
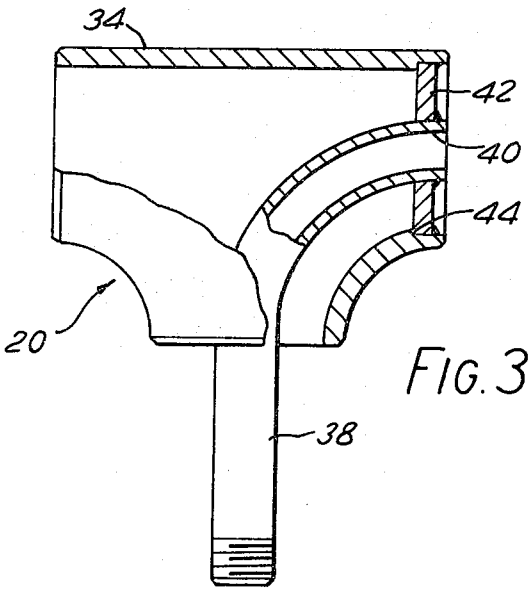
FIG. 3 is a front view of a recurring part of the refrigerant distribution means of FIG. 1, shown to a larger scale.

The common header 16 comprises a supply pipe 22 disposed coaxially within a collection pipe 24. As seen in FIG. 2, both the supply and collection pipes are closed at their ends and communicate at their midpoints with, respectively, a liquid supply riser 26 and a gaseous collection riser 28. The supply pipe is supported within the collection pipe by means of radially extending struts 30 which have a relatively small total contact area to minimise heat transfer. Thermal insulation 32 is provided on the exterior of the common header 16 only over its lower hemi-cylindrical surface.

On top of the common header 16, and equally spaced along its length, there are provided a number of connecting elements 20. Each connecting element comprises a T-shaped piece 34 which overlies a corresponding aperture 36 in the collection pipe and which is secured by welding into a shoulder cut around that aperture. The free ends of the T-shaped piece 34 are welded to respective ends of the associated rink pipe 18 and it will be seen that each rink pipe comprises a first limb extending from the T-shaped piece 34 away from the common header 16; a second limb extending from the T-shaped piece in the opposite direction; and a third limb—which is equal to the combined length of the first and second limbs—connected to the remote ends of the first and second limbs by means of U-shaped pieces not seen in FIG. 1.

In alignment with each T-piece 34, a relatively thin bore tube 38 extends radially from a screwed threaded attachment to the supply pipe 22. This tube 38 passes through the aperture 36 in the collection pipe and is bent towards its upper end to provide a jet 40 disposed coaxially within the cross portion of the T-piece 34. An annular plate 42 is secured by welding between the jet 40 and the T-piece and is located within a shoulder 44 cut into the T-piece.

The operation of the described apparatus can now be understood.

Liquid refrigerant from the refrigeration plant 10 passes up the supply riser 26 and into the supply pipe 22 of the common header. At each connecting element 20, liquid refrigerant is directed through tube 38 into one end of the rink pipe, passing along the first limb to one extremity of the ice rink, back along the third limb to the opposite extremity of the ice rink and finally returning along the second limb to the connecting element where it passes through the annular gap between the T-piece 34 and the tube 38 into the collecting pipe 24. In its passage along the rink pipe, the refrigerant absorbs heat from the ice rink, undergoing partial or complete vaporization. The return flow of gaseous refrigerant in the collection pipe has a significant cooling effect upon the supply pipe so that the heat gained by the supply pipe is less than is the case with conventional arrangements. Heat gain by the collection pipe is relatively small because of its situation in a low temperature region and, indeed, heat gain over the upper hemi-cylindrical surface of the collection pipe assists in the ice rink refrigeration. For this reason, the common header is insulated only over the lower hemi-cylindrical surface.

It will be appreciated that the positioning of the supply pipe within the collection pipe reduces overall bulk and restricts premature rise in temperature of the liquid refrigerant. Because the common header is positioned so close to the rink pipes, construction is simplified and costs reduced. Moreover, since the supply and collection pipes are situated in a low temperature region, there is no relative movement between these and the rink pipes due to differential thermal expansion and contraction; the complexities of flexible joints and the like can thus be avoided.

With the described use of a relatively small bore tube directing liquid refrigerant into each rink pipe, the flow resistance of each rink pipe can be made relatively high to ensure even distribution of refrigerant over the rink pipes. The need for control vales and the like is much reduced and so, accordingly, is the requirement for maintenance.

Since the supply pipe is contained within the collection pipe, slight leakage from the supply pipe can be accepted and the tubes 38 can be screw threaded into the supply pipe rather than welded. This simplifies the construction.

The use of a single connecting element to join the two ends of each rink pipe with the supply and connection pipes of the common header again simplifies construction. The number of different component parts required for the installation of a particular refrigeration apparatus is reduced and thus not only facilitates installation but also reduces manufacture costs.

It should be understood that this invention has been described by way of example only and a wide variety of modifications are possible without departing from the scope of the invention as defined in the appended claims. The skilled man will appreciate that other configurations of the common header and rink pipes are possible and while the described use of a single connecting element for each rink pipe is felt to have considerable advantages, there are other possible ways of connecting rink pipes with supply and connection pipes extending one longitudinally within the other.

What is claimed is:

1. Refrigerant distribution means for ice rink refrigeration apparatus, comprising a supply pipe for the supply of liquid refrigerant; a plurality of rink pipes connected with the supply pipe to receive liquid refrigerant therefrom and positioned beneath the ice rink to effect cooling by refrigerant vaporization; and a collection pipe connected with the rink pipes to collect vaporized or partially vaporized refrigerant, characterised in that the supply and collection pipes are arranged one extending longitudinally within the other to form a common header for the rink pipes and in the provision of respective T-shaped means for the supply and return connections of each rink pipe with the common header.

2. Distribution means according to claim 1, wherein the common header is positioned beneath the rink pipes.

3. Distribution means according to claim 2, wherein the common header is positioned substantially centrally of the ice rink.

4. Distribution means according to claim 1, wherein the supply pipe extends longitudinally within the collection pipe.

5. Distribution means according to claim 4, wherein the supply pipe is coaxially supported within the collection pipe by support means having a relatively small contact area with the respective pipes.

6. Distribution means according to claim 5, wherein the support means comprises a plurality of radially extending struts.

7. Distribution means according to claim 4, wherein the connecting elements each comprise a connecting member secured to the collection pipe about an aperture formed therein, the connecting member communicating with ends of the associated rink pipe; and liquid refrigerant directing means positioned within the connecting member and serving to direct liquid refrigerant from the supply pipe into one end of the associated rink pipe.

8. Distribution means according to claim 7, wherein the directing means comprises a tube extending radially from the supply pipe through said aperture in the collection pipe.

9. Distribution means according to claim 7 or claim 8, wherein the connecting member comprises a generally T-shaped pipe piece.

10. Distribution means according to claim 8 or claim 9, wherein the tube terminates in a throttling jet.

11. Distribution means according to claim 1, wherein the common header is provided with exterior thermal insulation only over its lower hemi-cylindrical surface.

12. Distribution means according to claim 1, wherein each rink pipe includes first and second limbs extending in respective opposite directions from the common header and a third limb extending parallel to and interconnecting the free ends of said first and second limbs.

13. Distribution means according to claim 12, wherein said rink pipe limbs extend perpendicularly of the common header.

14. Distribution means according to claim 1, wherein the free ends of each rink pipe are connected to a connecting element provided on the header for that rink pipe.

15. Refrigerant distribution means for ice rink refrigeration apparatus, comprising a supply pipe extending beneath the ice rink for the supply of liquid refrigerant; a plurality of rink pipes separately connected with the supply pipe to receive liquid refrigerant therefrom and positioned between the supply pipe and the ice rink to effect cooling of the ice rink by refrigerant vaporization; and a collection pipe connected with the rink pipes to collect vaporized or partially vaporized refrigerant therefrom, said supply pipe extending longitudinally within said collection pipe to form a common header for the rink pipes.

16. Refrigerant distribution means according to claim 15, wherein the common header is formed intermediate its ends with riser means enabling connection of the supply and collection pipes with refrigeration plant.

17. Refrigerant distribution means according to claim 15, wherein each rink pipe is connected at one end thereof with a corresponding aperture in the collection pipe and is connected at the opposite end with a tube extending through said aperture and communicating with the supply pipe.

* * * * *